United States Patent [19]

Oldham et al.

[11] 4,429,611

[45] Feb. 7, 1984

[54] AIRBORNE MISSILE LAUNCHER

[75] Inventors: Delbert J. Oldham, Chino; John A. Karish, Alta Loma, both of Calif.

[73] Assignee: General Dynamics, Pomona Division, Pomona, Calif.

[21] Appl. No.: 344,097

[22] Filed: Jan. 29, 1982

[51] Int. Cl.[3] ..... F41F 3/04

[52] U.S. Cl. ..... 89/1.816; 89/1.8; 89/1.819

[58] Field of Search ..... 89/1.816, 1.8, 1.811, 89/1.812, 1.801, 1.804, 1.813, 1.814, 1.5 C

[56] References Cited

U.S. PATENT DOCUMENTS

| | | | |
|---|---|---|---|
| 3,145,619 | 8/1964 | Ozanne | 89/1.819 |
| 3,315,565 | 4/1967 | Nash | 89/1.816 X |
| 3,412,640 | 11/1968 | Nash | 89/1.816 X |
| 3,766,828 | 10/1973 | Cords | 89/1.8 |

*Primary Examiner*—David H. Brown

*Attorney, Agent, or Firm*—Neil J. Martin; Freling E. Baker; Edward B. Johnson

[57] ABSTRACT

An airborne missile launcher for air launching of man-portable, tube-launched missiles includes a central support frame with attachment means for detachable attachment to an aircraft or other launching platform, with a central frame member having a launch tube saddle support assembly at each side of the frame member with quick detachable clamp means and an alignment guide for quickly positioning and securing launch tubes into position with auto connecting means for automatically connecting the electronics control system and coolant gas to the launch tube assembly upon clamping the assembly into position. An aerodynamic shell encloses the support structure and includes a quick release cover for providing access to the tube clamp assemblies for loading and unloading launch tubes.

25 Claims, 9 Drawing Figures

AIRBORNE MISSILE LAUNCHER

BACKGROUND OF THE INVENTION

The present invention relates to missile systems and pertains particularly to a system for launching man-portable missiles from aircraft.

Military aircraft typically provide close support for infantry and other troops. Such military aircraft are normally equipped with launchers for firing missiles and other types of weapons.

Helicopter aircraft frequently provide much closer support than other aircraft and are frequently stationed in close proximity to ground troop camps and the like. Ground troops typically handle a wide arsenal of weapons available to them, including anti-aircraft rocket missiles. Many of these rocket missiles are self-guided "fire-and-forget" types designed for man-portable tube-launched shoulder firing. These weapons are capable of destroying aircraft in flight and destroying or disabling armored ground equipment such as tanks and the like. A prime example of such weapons is the man-portable, tube-launched anti-aircraft weapon called Stinger.

Because of the capabilities of such missiles, it is desirable that aircraft launchers be available for these weapons. In particular, it is desirable that launchers capable of launching these weapons with no modification or minimal modification be available.

SUMMARY AND OBJECTS OF THE INVENTION

Accordingly, it is the primary object of the present invention to provide an aero launcher for man-portable rocket missiles.

In accordance with the primary aspect of the present invention, an airborne launcher is provided which includes quick release clamps and auto connect electronic means and which is capable of readily receiving unmodified or minimally modified launch tubes of man-portable rocket missiles for quick and easy loading of such launcher.

BRIEF DESCRIPTION OF THE DRAWINGS

The above and other objects and advantages of the present invention will become apparent from the following description when read in conjunction with the drawings wherein.

DETAILED DESCRIPTION OF A PREFERRED EMBODIMENT

Figure 1:
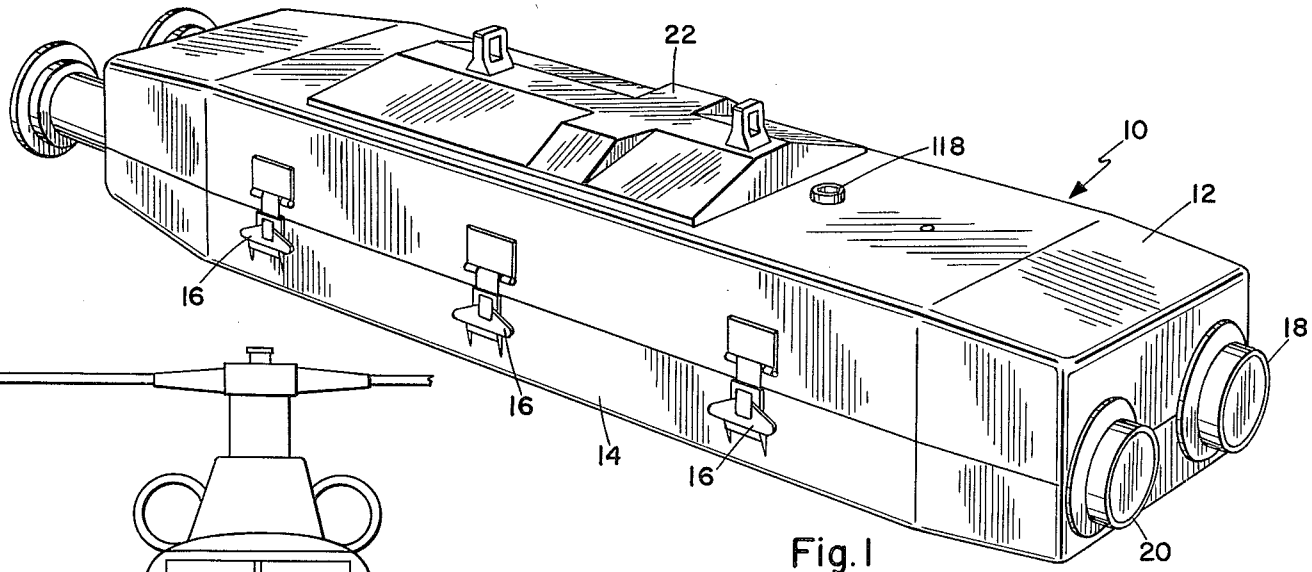
FIG. 1 is a perspective view of the complete launcher unit.

Turning to FIG. 1 of the drawing, a missile launcher in accordance with the invention is designated by the numeral 10 and as shown has a somewhat aerodynamically configured casing or shell, having an upper fixed half-shell portion 12 that is secured to the framework of the unit and a lower releasable half-shell portion 14 that is detachably clamped or secured to the fixed or stationary upper shell 12 by means of a plurality of quick releasable clamps 16 (on each side) of the type known as suitcase or trunk clamps. These permit the quick release of the undershell to allow it to fall or pivot away and provide quick access to the missile tubes 18 and 20, which are releasably secured within the unit. Each shell includes semi-circular cutouts at each end that mate and encircle the launch tubes enabling the ends thereof to protrude beyond the shell.

The launcher includes an attachment plate 22 which adapts it to fit mounting pylons of an aircraft or other suitable launch vehicle. Preferably, the mounting plate or assembly 22 may fit bomb release pylons or supports on the aircraft to permit release of the spent rocket launcher assembly. Additionally, the assembly may be adapted to mount plural units, one below the other, or beside the other to permit mounting of multiple units on a particular aircraft.

Figure 2:
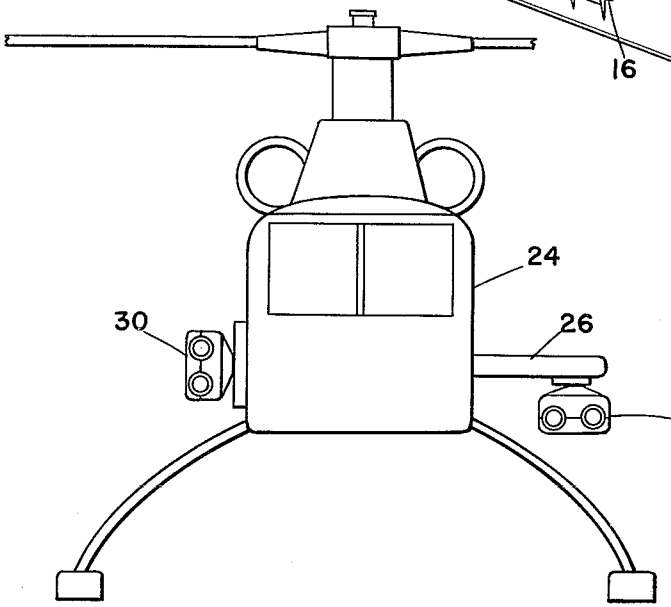
FIG. 2 is a front elevation view of a typical helicopter, showing alternative mounting positions for the launcher unit.

Turning to FIG. 2, a typical launch platform such as a helicopter 24 includes, for illustrative purposes, a mounting pylon 26 on one side on which a missile launcher 28 is mounted and an alternate mounting assembly is shown on the opposite side of the aircraft showing a launcher 30 oriented at a 90° angle to that of the launcher 28 on the one side of the aircraft. These launchers are adapted to accommodate and receive the unmodified launch tubes of the man-portable type missile rockets such as that known as the Stinger and similar rockets. Some of the rockets are primarily designed as anti-aircraft weapons for infantry use by shoulder launch, for example. However, the present invention permits ready use of the available stockpile of such self-guided missiles such as the Redeye and Stinger without modification thereof. The Stinger is a "fire-and-forget" weapon with a passive-homing IR seeker guidance system. The missile is packaged in a throw away launch tube and is delivered ready for launching by means of a reusable gripstock.

Figure 8:
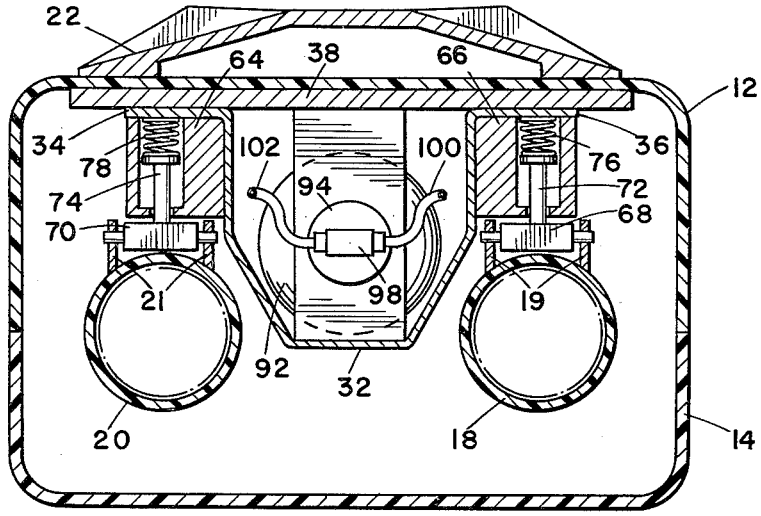
FIG. 8 is an enlarged sectional view taken on line 8—8 of FIG. 3.
Figure 9:
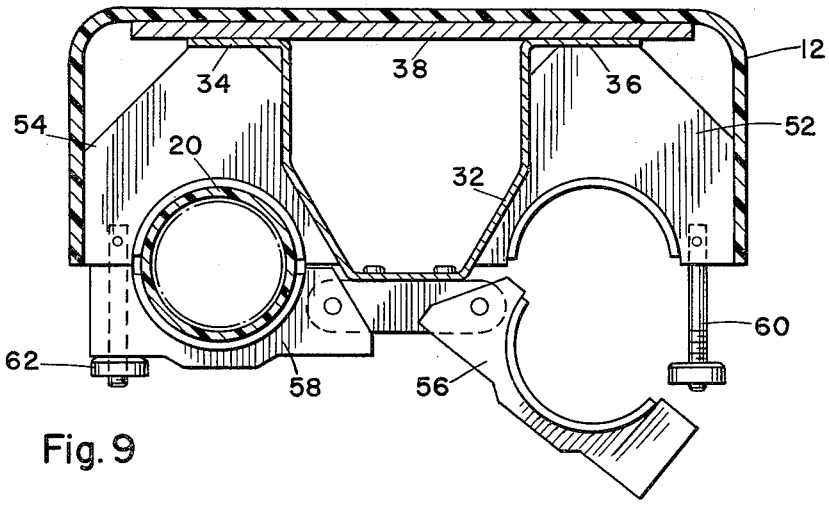
FIG. 9 is an enlarged sectional view taken on line 9—9 of FIG. 3, with one clamp shown open.

Turning to FIG. 9, launcher includes a central frame assembly comprising a generally U-shaped elongated beam or channel member 32 extending substantially the length of the housing and including a pair of outwardly extending flanges 34 and 36 extending the length thereof and connected to an elongated generally rectangular reenforcing plate 38 at the top of the housing. This framework is connected through the housing shell 12 to the mounting bracket 22 (FIG. 8) and forms the basic support structure for the assembly. The channel 32, as will be explained, includes cutout sections for accommodating a cryogenic bottle and other units such as the electronics power supply and control assembly.

Figure 7:
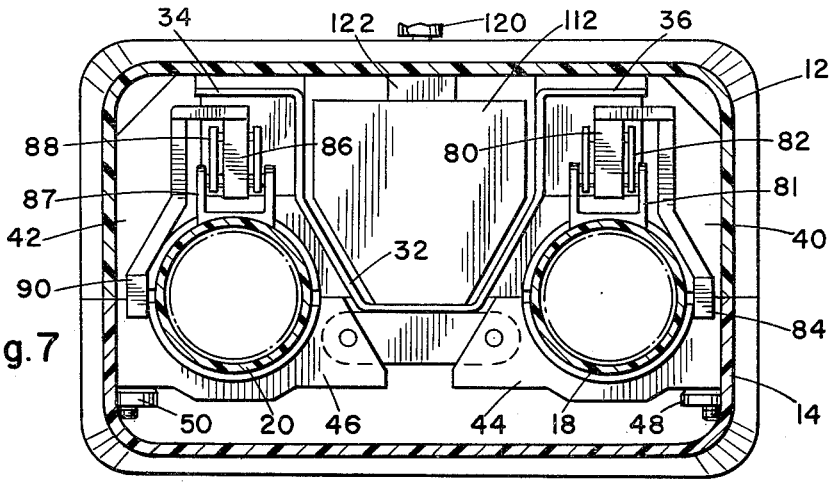
FIG. 7 is an enlarged sectional view taken on line 7—7 of FIG. 3.

The rocket tubes 18 and 20 (FIG. 8) are positioned to each side of the central channel member and are cradled within fore and aft clamping brackets. Each missile tube mounting assembly includes a fore and aft clamp as best seen in FIGS. 3, 4, 7 and 9. Turning more specifically to FIG. 7, each forward clamp assembly includes a fixed base cradle member 40 and 42 with pivoting cap members 44 and 46 each respectively held in position by a screw and thumbnut assembly 48 and 50. The caps pivot to the fixed or cradle members on the inside and open to the outside permitting side access to the launch tubes.

A similar aft or rear clamp assembly as best seen in FIG. 9, similarly include base cradle members 52 and 54 with pivoting cap members 56 and 58 held in place by pivotally mounted thumbscrew assemblies 60 and 62. The pivoting cap members, as can be appreciated from FIG. 9, pivot away and permit each rocket launch tube to be pulled downward and to the side removing it from the launcher. This permits side loading (i.e. from the side) of the launch tubes which permits the loader to avoid getting either in front or behind the missile launch tube.

Turning to FIG. 8, an alignment and positioning guide bracket for each launch tube includes base members 64 and 66 in which is reciprocally mounted a floating pin assembly 68 and 70, each of which is mounted on plungers 72 and 74 biased to the extended position. The pins on the pin assembly engage or are engaged by slotted openings in brackets 19 for missile tube 18 and brackets 21 for missile tube 20. These brackets are existing structure on the launch tubes for engaging and connecting to the gunners grip stock and shoulder launch assemblies. These positioning and alignment brackets serve to axially align the tube and position it axially along the housing in a position to pivotally move upward into clamping position and to simultaneously automatically connect with a gas socket assembly and an electrical socket assembly for connecting the rocket respectively to the cooling gas of the system and to the electronic control system.

Each rocket is also provided with a latch as shown in FIG. 7, including a latch hook 80 pivotally mounted in a bracket 82 and including a lever 84 for releasing the latch. A similar latch assembly for the other rocket includes a latch hook 86 pivotally mounted on a bracket 88 with a latch releasing arm 90 connected thereto. The latch hooks 80 and 86 engage existing brackets 81 and 87 on the forward ends of launch tubes 18 and 20, respectively.

The rocket launcher is completely self-contained and contains the necessary electronics control and actuation means for controlling the launch of the respective rocket missiles. However, each launcher is connected by a umbilical control cord to the cockpit of the aircraft to permit the pilot or other control person to fire the rockets.

Figure 3:
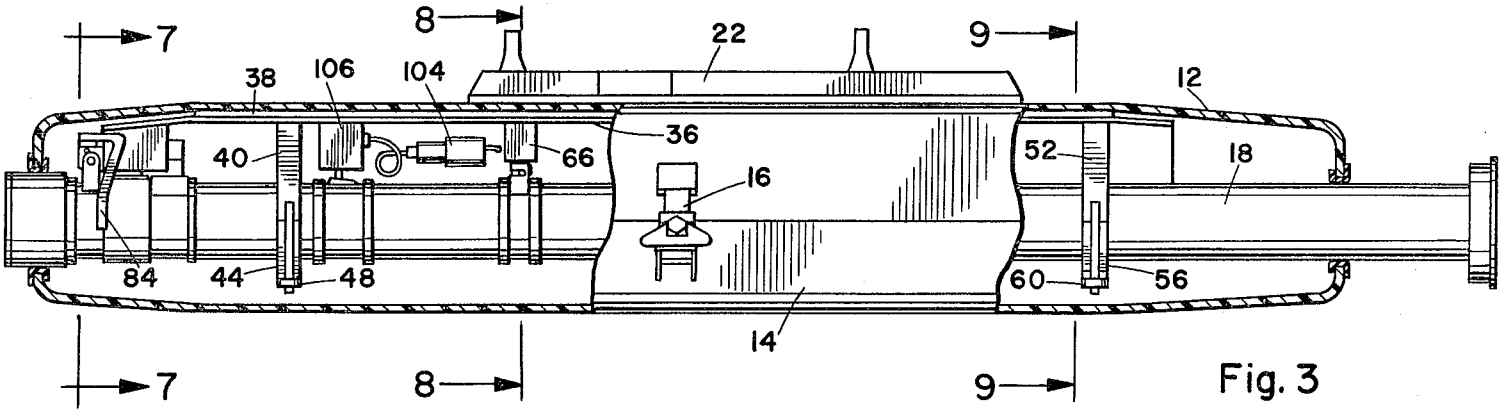
FIG. 3 is a side elevation view of the launcher unit with portions of the casing cutaway.
Figure 4:
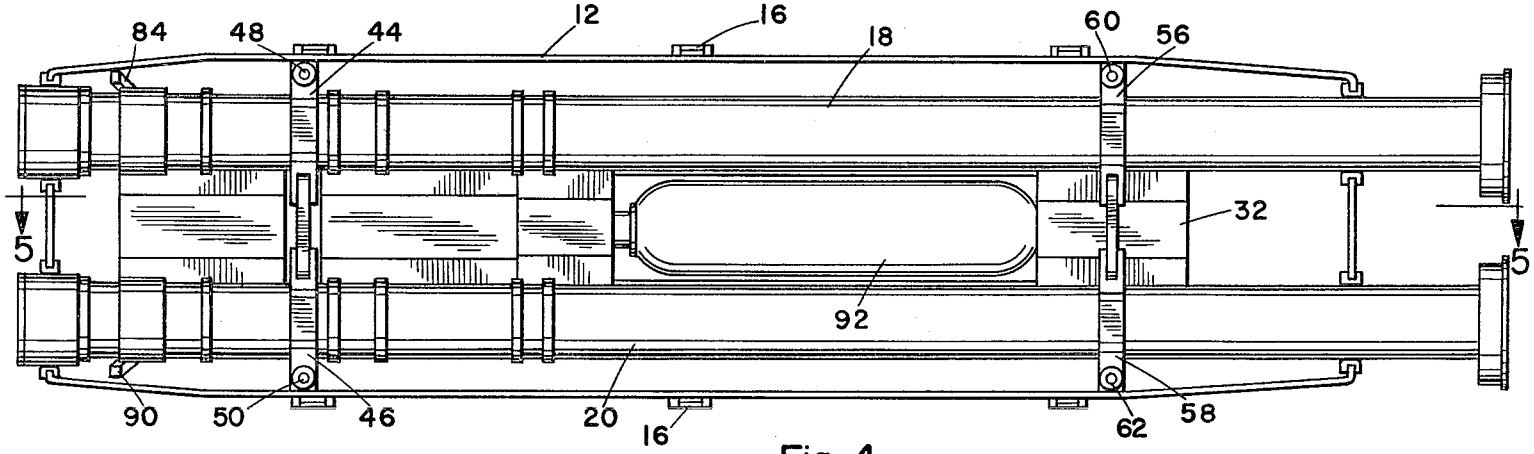
FIG. 4 is an underside view of the unit with the lower casing shell removed.
Figure 5:
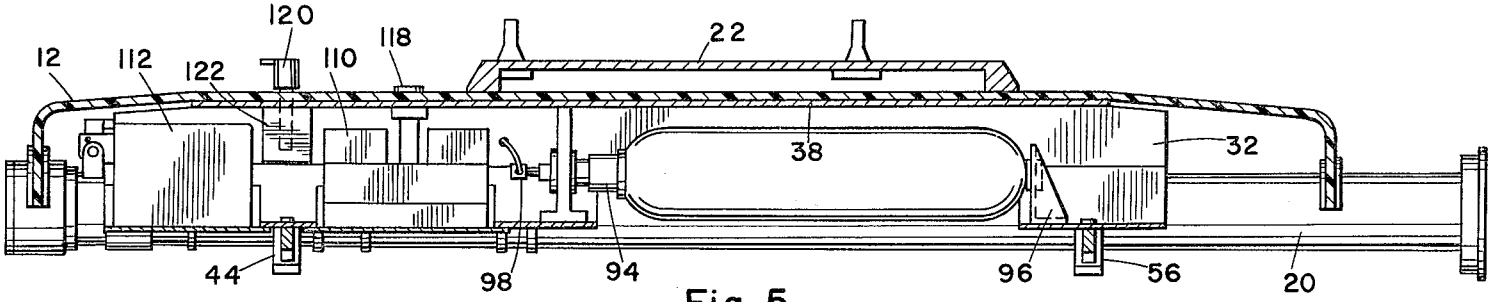
FIG. 5 is a sectional view taken on line 5—5 of FIG. 4.
Figure 6:
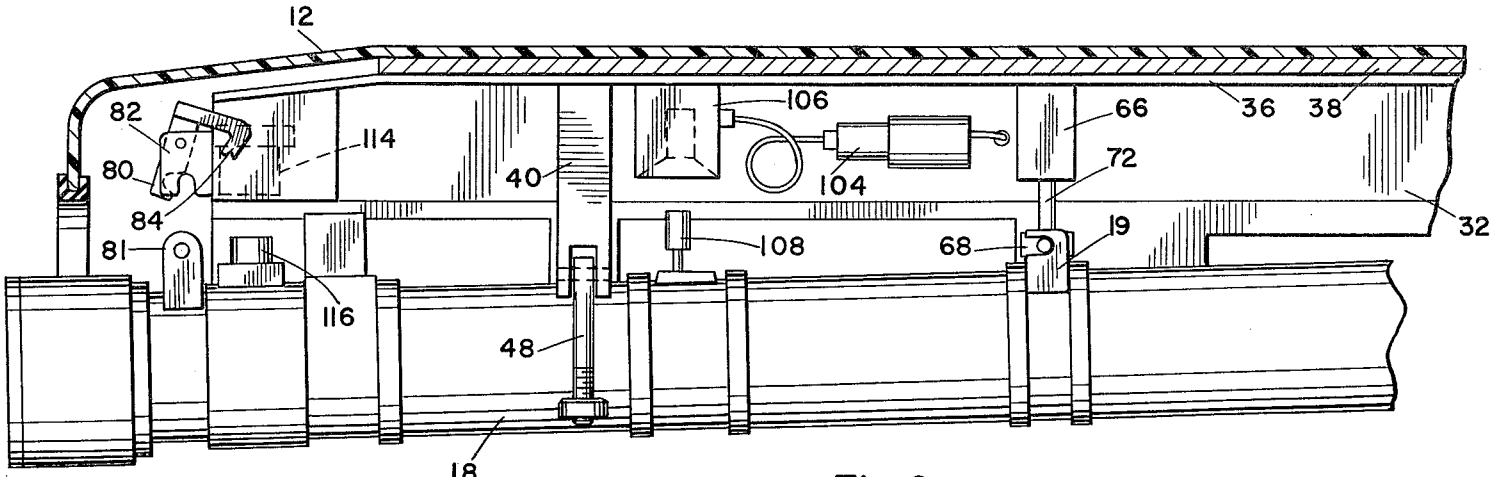
FIG. 6 is an enlarged view similar to a portion of FIG. 3 showing a missile launching tube partially inserted.

As best seen in FIGS. 4 and 5, a coolant system for the infrared seeker of each rocket includes a source of coolant gas which in this instance comprises a removable 2.0 liter tank or bottle 92 of highly compressed (6000 psi) argon gas which is mounted within a cutout in the channel assembly in a bracket including a gas connector or coupling socket 94 at the forward end thereof and a releasable mounting bracket 96 engaging the rear end of the gas bottle. The coupling socket 94 couples the gas tank into a gas system including a manifold 98 for distributing the coolant gas by way of separate lines 100 and 102 as shown in FIG. 8 and through individual solenoid controlled valves, one of which is shown in FIG. 3 at 104, to a coupling socket 106 which registers with a valve actuating pin and plug 108 on the respective launcher tube as shown in FIG. 6. Control means within the electronics system as will be described, serves to time and activate the coolant gas for maintaining the infrared seeker detector cool during the operation thereof. The above described supply provides sufficient coolant for 40 cooling cycles of 40 seconds each.

As best seen in FIG. 5, disposed within a cutout in the main or central channel is the electronic control system for the launcher. This electronic control system includes a power pack assembly 110 which in turn is connected to the electronics control pack or assembly 112. The electronics control system, the details of which are not shown herein, includes the necessary control electronics for controlling the rockets for activating and controlling the seeking head thereof and for activating the guidance system herein. This control pack is designed to be modified by means of plug-in cards in a wellknown manner for updating and adaptation for alternate versions of the rockets. The control pack 112 is connected through a plug and socket arrangement, the socket of which is shown at 114 in FIG. 6 with the plug shown at 116.

The previously described alignment and positioning bracket assembly as shown in FIG. 8 serves to position and guide the rocket launch tube such that, as shown in FIG. 6, movement of the rocket launch tube upward (when properly positioned) automatically plugs the gas valve connector 168 and the electrical socket connector 116 in their respective connective sockets. This automatically connects the coolant gas supply and the electronics to the rocket launch tube.

The electronic controls are connected to the aircraft 24 by means of an umbilical cord (not shown) connected to a socket 118 as shown in FIG. 5. This permits control of the launch of the rockets from the aircraft. A safety firing pin 120 inserts into a switch unit 122 for deactivation of the launch controls until the launcher is fully loaded and ready for arming. When it is desired to arm the launcher, the pin 120 is removed by pulling it directly out of the bore which activates and arms the launcher.

The rocket launch tubes are each sealed on both ends by plastic caps prior to shipment. These caps remain in place and are automatically ejected by the rocket upon launch.

Thus, it is seen from the above description, we have provided an improved launcher for adapting and accommodating unmodified or minimally modified manportable rockets for air transport and launching.

While we have illustrated and described our invention by means of specific embodiments, it is to be understood that numerous changes and modifications may be made therein without departing from the spirit and scope of the invention as defined in the appended claims.

We claim:

1. An airborne missile launcher for air launching of man-portable tube-launched missiles, said launcher comprising:

a central support frame including attachment means for attachment to an aircraft;

clamp means for releasably clamping a plurality of missile containing launch tubes to said support frame;

electronic control means mounted on said support frame and including connecting means for automatic interconnection with electronic means in said launch tubes upon clamping said launch tubes in place;

aerodynamic shell means for enclosing said support frame and said electronic control means;

a source of coolant fluid and control means associated therewith mounted on said support frame for controlling communication of coolant therefrom to said missile; and automatic connecting means for automatically connecting said source of coolant fluid to said launch tubes upon clamping said launch tubes in place.

2. The missile launcher of claim 1 including latch means disposed at the forward end of said support frame for engaging pin means on a launch tube for retaining the launch tube seated in the clamp means.

3. The missile launcher of claim 1 wherein said connecting means is located substantially at the forward end of said support frame.

4. The missile launcher of claim 1 wherein said aerodynamic shell includes an upper fixed half-shell and a lower removable half-shell enclosing said support frame and at least a major portion of missile launch tubes mounted in said clamp means.

5. The missile launcher of claim 1 comprising:

alignment means including a longitudinal locating pin assembly engageable by brackets on the missile launch tubes for positioning and aligning said launch tubes for engagement with said automatic connection means.

6. The missile launcher of claim 5 wherein said pin assembly is biased outward from said support frame for engagement by a launch tube prior to seating of the launch tube into the clamp means.

7. The airborne missile launcher of claim 1 wherein:

said central support frame includes an elongated generally U-shaped beam, and clamp means includes a fore and aft clamp exposed at each side of said beam for releasably clamping a rocket launch tube thereto.

8. The airborne missile launcher of claim 7 wherein:

said elongated U-shaped beam defines a central housing, and said electronic control means is mounted within said central housing.

9. The missile launcher of claim 8 wherein:

said source of coolant fluid is a container of compressed gas disposed in said central housing.

10. The missile launcher of claim 7 comprising:

alignment means including a longitudinal locating pin assembly engageable by brackets on the missile launch tubes for positioning and aligning said launch tubes for engagement with said automatic connection means.

11. The missile launcher of claim 10 wherein said pin assembly is biased outward from said support frame member for engagement by the launch tube prior to seating of the launch tube into the clamp means.

12. The missile launcher of claim 11 including latch means disposed at the forward end of said support frame for engaging pin means on the launch tube for retaining the launch tube seated in the clamp means.

13. The missile launcher of claim 12 wherein said connecting means is located substantially at the forward end of said frame.

14. The missile launcher of claim 13 wherein said automatic connecting means is located just aft of the forward end of said frame.

15. The missile launcher of claim 14 wherein said aerodynamic shell includes an upper fixed half-shell and a lower removable half-shell enclosing said support frame and at least a major portion of missile launch tubes mounted in said clamp means.

16. An airborne missile launcher for air launching of man-portable tube-launched missiles, said launcher comprising:

a central support frame including attachment means for attachment to an aircraft;

clamp means for releasably clamping a plurality of missile containing launch tubes to said support frame;

electronic control means mounted on said support frame and including electrical connecting means for automatic interconnection with electronic means in said launch tubes upon clamping said launch tubes in place;

aerodynamic shell means for enclosing said support frame and said electronic control means, said aerodynamic shell includes an upper fixed half-shell and a lower removable half-shell enclosing said support frame and at least a major portion of missile launch tubes mounted in said clamp means.

17. The missile launcher of claim 16 including latch means disposed at the forward end of said support frame for engaging pin means on a launch tube for retaining the launch tube seated in the clamp means.

18. The missile launcher of claim 16 wherein said electrical connecting means is located substantially at the forward end of said frame.

19. The airborne missile launcher of claim 16 wherein:

said central support frame includes an elongated generally U-shaped beam, and said clamp means includes a fore and aft clamp exposed at each side of said beam for releasably clamping a rocket launch tube thereto.

20. The airborne missile launcher of claim 19 wherein:

said elongated U-shaped beam defines a central housing, and said electronic control means is mounted within said central housing.

21. The missile launcher of claim 17 wherein:

said source of coolant fluid is a container of compressed gas disposed on said central housing.

22. The missile launcher of claim 18 comprising:

alignment means including a longitudinal locating pin assembly engageable by brackets on the missile launch tubes for positioning and aligning the tubes for engagement with said automatic connection means.

23. The airborne missile launcher of claim 16 comprising:

a source of coolant fluid and control means associated therewith mounted on said support frame for controlling communication of coolant therefrom to said missile, and automatic connecting means for automatically connecting said source of coolant fluid to said launch tube upon clamping said launch tube in place.

24. The missile launcher of claim 22 wherein said pin assembly is biased outward from the frame member for engagement by a launch tube prior to seating of the launch tube into the clamp means.

25. The missile launcher of claim 23 wherein said coolant automatic connecting means is located just aft of the forward end of said frame.

* * * * *